US006691684B1

(12) United States Patent
Bruenemann et al.

(10) Patent No.: US 6,691,684 B1
(45) Date of Patent: Feb. 17, 2004

(54) FUEL FRACTIONATION DEVICE AND METHOD OF MAKING SAME

(75) Inventors: Ralf Bruenemann, Stuttgart (DE); Eberhard Holder, Kusterdingen (DE); Roland Kemmler, Stuttgart (DE); Martin Matt, Bruchsal-Untergrombach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/216,642

(22) Filed: Aug. 12, 2002

(30) Foreign Application Priority Data

Aug. 10, 2002 (DE) ..... 101 39 527

(51) Int. Cl.[7] ..... F02B 43/08
(52) U.S. Cl. ..... 123/525
(58) Field of Search ..... 123/525, 548, 123/575, 3

(56) References Cited

U.S. PATENT DOCUMENTS 2,865,355 A * 12/1958 Hilton ..... 123/575
3,794,000 A * 2/1974 Hodkinson ..... 123/557
4,876,989 A * 10/1989 Karpuk et al. ..... 123/3
5,546,908 A * 8/1996 Stokes ..... 123/525
6,571,748 B2 * 6/2003 Holder et al. ..... 123/3
6,622,665 B2 * 9/2003 Holder et al. ..... 123/3

FOREIGN PATENT DOCUMENTS

DE 19927177 7/2000

* cited by examiner

*Primary Examiner*—Henry C. Yuen
*Assistant Examiner*—Jason Benton
(74) *Attorney, Agent, or Firm*—Crowell & Moring LLP

(57) ABSTRACT

A fuel fractionation device is provided for separating a low-boiling fuel fraction from a liquid fuel in an internal combustion engine, having a fuel tank which contains the liquid fuel and having a separator, to which an extracted fuel fraction mixture can be fed, and a reservoir to which the fuel fraction can be fed, and furthermore having a pump which extracts fuel vapor and air and has a pump drive. The pump and the pump drive are fixed in a housing and are accommodated removably in the fuel tank together with the separator and the reservoir, forming a structural unit.

26 Claims, 1 Drawing Sheet

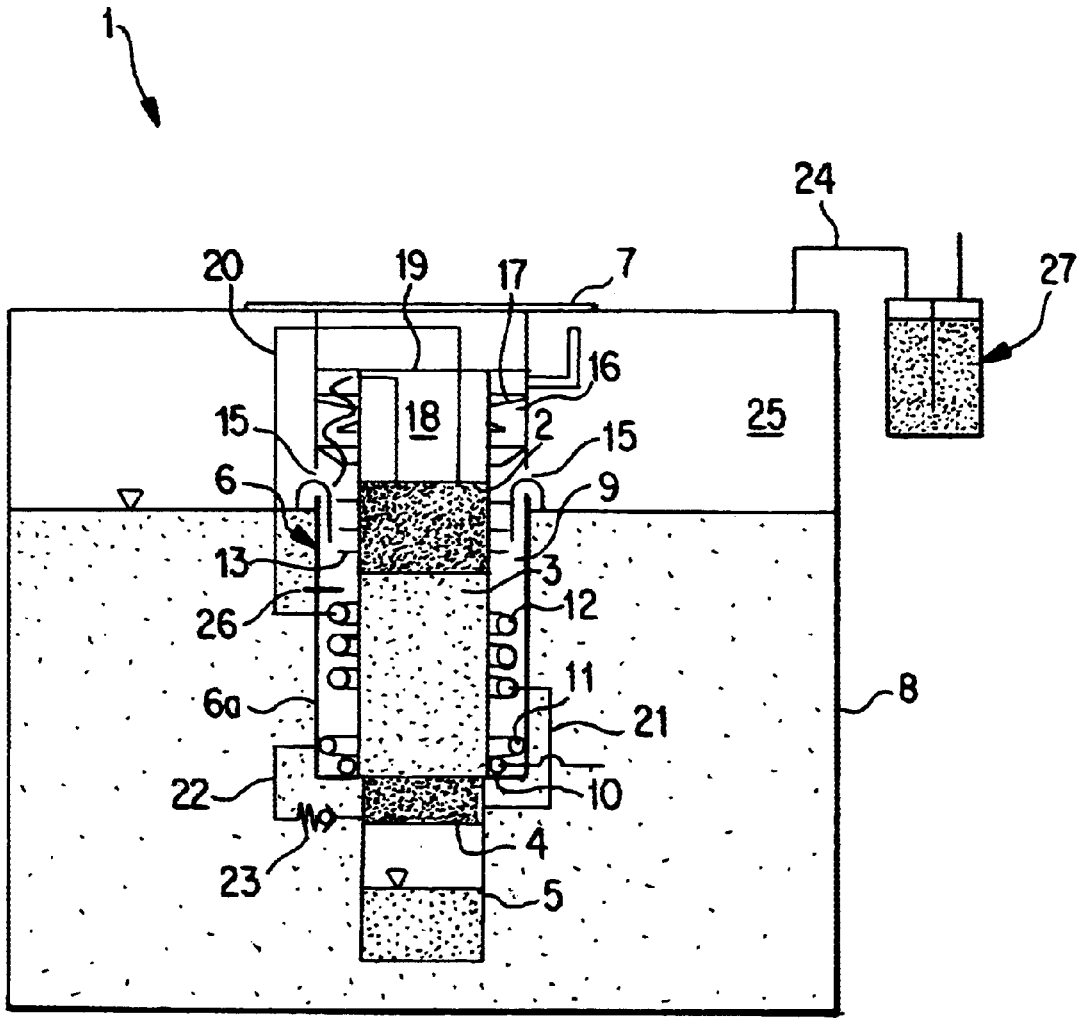
1
24
20
19
17
7
27
16
18
25
15
2
15
6
9
13
3
26
12
11
6a
21
8
22
10
4
23
5

FUEL FRACTIONATION DEVICE AND METHOD OF MAKING SAME

This application claims the priority of German Patent Document DE 101 39 527.2, filed on Aug. 10, 2001, the disclosure of which is expressly incorporated by reference herein.

BACKGROUND AND SUMMARY OF THE INVENTION

The invention relates to a fuel fractionation device for separating a low-boiling fuel fraction from a liquid fuel in an internal combustion engine comprising a fuel tank which contains the liquid fuel, a separator, to which an extracted fuel fraction mixture can be fed, a reservoir to which the fuel fraction can be fed, and a pump which extracts fuel vapor and air and has a pump drive.

A fuel fractionation device of this type is known from German Patent Document DE 199 27 177 C1 and corresponding U.S. Patent Document No. 2002062794. This fuel fractionation device has an exposed system of lines which is connected to the fuel tank and has a pump, a heat exchanger, a separator and a reservoir. The pump extracts an air/fuel fraction mixture from a gas collection space in the fuel tank via a suction line and feeds this mixture to the separator via a pressure line which includes the heat exchanger. The fuel fractionation device takes up a not inconsiderable amount of space.

The invention has as an aspect designing a fuel fractionation device of the type described in the introduction in such a manner that it requires considerably less space and, furthermore, causes less noise when it is operating.

According to certain preferred embodiments of the invention, in a fuel fractionation device of the type described in the introduction, this is achieved in that the pump and the pump drive are fixed in a housing and are accommodated removably in the fuel tank together with the separator and the reservoir, forming a structural unit.

Combining the functional elements to form a structural unit which is integrated in the fuel tank not only considerably reduces the volume of the fuel fractionation device but also reduces the structural outlay. Furthermore in the case of a fault in the structural unit, this unit can easily be removed from the fuel tank. The fact that the pump and the pump drive are accommodated in a common housing, i.e. are encapsulated, means that the noise produced is damped.

Other features are described which may be included in certain preferred embodiments of the invention.

For example, the inventive design of an annular space between the housing and the pump and the pump drive creates the possibility of accommodating further functional elements, such as an air distributor, a fuel distributor and a heat exchanger, in the housing.

Other objects, advantages and novel features of the present invention will become apparent from the following detailed description of the invention when considered in conjunction with the accompanying drawings.

BRIEF DESCRIPTION OF THE DRAWINGS

FIG. 1 shows a fuel fractionation assembly.

DETAILED DESCRIPTION OF THE DRAWINGS

The exemplary embodiment shown in FIG. 1 provides a fuel fractionation device 1 substantially comprising a pump

2 and a pump drive 3 formed by an electric motor, a separator 4 and a reservoir 5 for low-boiling fuel. The four functional elements are of cylindrical configuration, are arranged coaxially with respect to one another and form a structural unit together with a housing 6 which surrounds the pump 2 and the electric motor 3 at a distance and is designed in the form of a sleeve.

While the upper pump 2, which can be formed as an air pump, and the electric motor 3 arranged below it are mounted in the housing 6, the separator 4, which is fixedly connected to the electric motor, and the reservoir 5 project out of the housing 6. The housing 6 together with the outer separator 4 and the reservoir 5 produces an elongate, slender design. In the upper end region of the housing 6 there is a securing flange 7, by way of which the structural unit is secured to a fuel tank 8 so as to project vertically into it. This fuel tank 8 corresponds to the standard fuel tank of an internal combustion engine.

Between the housing 6, on the one hand, and the electric motor 3 and the air pump 2, on the other hand, there is an annular space 9, in which an annular fuel distributor 10 and an air distributor 11 which is offset with respect to the fuel distributor are provided in the lower region of the housing 6, close to the separator. The electric motor 3 is directly surrounded by the fuel distributor 10, while the air distributor 11 bears against the inner wall of the housing 6.

The fuel distributor 10 and air distributor 11 are provided with small openings for separately supplying fuel and air. Small air bubbles are formed which, together with the fuel, flow past a heat exchanger 12 arranged in the space 9 and are heated at the surface of the heat exchanger 12. The fuel-air mixture flows onward past cooling fins 13, which project from the air pump 2. In the process, the fuel-air mixture is heated further. In the process, the air bubbles are enriched with low-boiling fuel constituents.

At its sleeve part 6*a*, the housing 6 has openings 15 which are arranged at the same height above the maximum fuel filling level in the fuel tank 8, in order to allow liquid residual fuel to flow out to the outside.

In the upper region of the space 9, fuel vapor and air are extracted by the air pump 2 and compressed. A droplet separator 16 is formed by encircling ribs 17 in the space 9, which on one side are arranged on a cylindrical closure part 19, which lies above the air pump 2 and has a cavity 18, and on the other side are arranged on the inner wall of the housing 6, the arrangement specifically alternating in the dropping-down direction. The residual fuel droplets which are still in the airstream are retained by this labyrinth separation.

After the air pump 2, the mixture flows through the heat exchanger 12 via a line connection 20 and in the process is cooled, during which time the fuel vapor is condensed. The air conveys the condensate via a line 21 into the separator 4 in order to separate air and condensate. The air emerges from the separator 4 into a line 22 which connects the separator to the air distributor and includes a pressure valve 23. The air passes this pressure valve 23, is expanded to ambient pressure and then passes back into the air distributor 11 in the space 9.

A compensation line 24 connects the upper part of the space 9 to the vapor space 25 in the fuel tank 8. This ensures that the air pump 2 does not suck up any liquid fuel at the start of fractionation even when the fuel tank 8 is completely full.

An activated carbon vessel which interacts with the fuel tank 8 is denoted by 27.

The quantity of fuel which is conveyed to the fuel fractionation device is preferably branched off from the fuel return of the main fuel supply of the vehicle and can be regulated as a function of the temperature of the fuel return.

Furthermore, the compression pressure of the fuel pump 2 can be regulated as a function of the fuel temperature by way of the pressure valve 23.

At extremely low fuel temperatures, the air-fuel mixture above the heat exchanger 12 may additionally be heated by an electrical heater 26 which is secured to the housing 6 and projects into the space 9.

The low-boiling fuel fraction is fed to the internal combustion engine for starting and warming up. The injection pressure required for this purpose can be generated in the form of a pressure cushion by the air pump 2 or by way of an additional fuel pump.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fuel fractionation device for separating a low-boiling fuel fraction from a liquid fuel for an internal combustion engine, comprising: a fuel tank which contains the liquid fuel, a separator to which an extracted fuel fraction mixture can be fed, a reservoir to which the fuel fraction can be fed, and a pump which extracts fuel vapor and air and has a pump drive, wherein the pump and the pump drive are fixed in a housing and are accommodated removably in the fuel tank together with the separator and the reservoir, forming a structural unit.

2. Fuel fractionation device according to claim 1, wherein the housing and at least the coaxially located pump and the pump drive are cylindrical in shape, the housing surrounding the pump and the pump drive below forming an annular space.

3. Fuel fractionation device according to claim 2, wherein the space, in a bottom region near the separator, has an annular fuel distributor and an annular air distributor, which is offset with respect to the fuel distributor, each of the distributors having small openings.

4. Fuel fractionation device according to claim 2, wherein the pump is provided on a circumferential side with cooling fins which project into the space, and wherein a heat exchanger is arranged in the space, between the housing and the pump drive.

5. Fuel fractionation device according to claim 3, wherein the pump is provided on a circumferential side with cooling fins which project into the space, and wherein a heat exchanger is arranged in the space, between the housing and the pump drive.

6. Fuel fractionation device according to claim 2, wherein a labyrinth separation, which is formed by ribs, is provided in the space, between the pump and an upper region of the housing which is remote from the separator.

7. Fuel fractionation device according to claim 3, wherein a labyrinth separation, which is formed by ribs, is provided in the space, between the pump and an upper region of the housing which is remote from the separator.

8. Fuel fractionation device according to claim 4, wherein a labyrinth separation, which is formed by ribs, is provided in the space, between the pump and an upper region of the housing which is remote from the separator.

9. Fuel fractionation device according to claim 6, wherein the ribs, as encircling ribs, as seen in a dropping-down direction, are arranged alternately on a inner wall of the housing and on an outer wall of a closure part which lies above the pump.

10. Fuel fractionation device according to claim 7, wherein the ribs, as encircling ribs, as seen in a dropping-down direction, are arranged alternately on a inner wall of the housing and on an outer wall of a closure part which lies above the pump.

11. Fuel fractionation device according to claim 8, wherein the ribs, as encircling ribs, as seen in a dropping-down direction, are arranged alternately on a inner wall of the housing and on an outer wall of a closure part which lies above the pump.

12. Fuel fractionation device according to claim 1, wherein the housing is provided with openings which lie at a height above a maximum fuel filling level in the fuel tank.

13. Fuel fractionation device according to claim 2, wherein the housing is provided with openings which lie at a height above a maximum fuel filling level in the fuel tank.

14. Fuel fractionation device according to claim 3, wherein the housing is provided with openings which lie at a height above a maximum fuel filling level in the fuel tank.

15. Fuel fractionation device according to claim 4, wherein the housing (6) is provided with openings which lie at a height above a maximum fuel filling level in the fuel tank.

16. Fuel fractionation device according to claim 6, wherein the housing is provided with openings which lie at a height above a maximum fuel filling level in the fuel tank.

17. Fuel fractionation device according to claim 1, wherein the housing, at an end which is remote from the separator, has a securing flange, by way of which the housing together with the separator and the reservoir are secured to the fuel tank, projecting vertically into the fuel tank.

18. Fuel fractionation device according to claim 2, wherein the housing, at an end which is remote from the separator, has a securing flange, by way of which the housing together with the separator and the reservoir are secured to the fuel tank, projecting vertically into the fuel tank.

19. Fuel fractionation device according to claim 3, wherein the housing, at an end which is remote from the separator, has a securing flange, by way of which the housing together with the separator and the reservoir are secured to the fuel tank, projecting vertically into the fuel tank.

20. Fuel fractionation device according to claim 4, wherein the housing, at an end which is remote from the separator, has a securing flange, by way of which the housing together with the separator and the reservoir are secured to the fuel tank, projecting vertically into the fuel tank.

21. Fuel fractionation device according to claim 6, wherein the housing, at an end which is remote from the separator, has a securing flange, by way of which the housing together with the separator and the reservoir are secured to the fuel tank, projecting vertically into the fuel tank.

22. Fuel fractionation,device according to claim 12, wherein the housing, at an end which is remote from the separator, has a securing flange, by way of which the housing together with the separator and the reservoir are secured to the fuel tank, projecting vertically into the fuel tank.

23. A fuel fractionation assembly for separating a light fuel fraction from a liquid fuel, comprising:

a separator which is capable of receiving an extracted fuel fraction mixture, a reservoir which is capable of receiving the fuel fraction mixture, a pump which extracts fuel vapor and air, a pump drive, and a housing in which the pump and pump drive are fixed, wherein the housing, pump, pump drive, separator, and reservoir form a structural unit which is removable from a fuel tank containing the liquid fuel.

24. A fuel fractionation assembly according to claim 23, wherein the pump and pump drive, which are coaxial, and the housing are cylindrical, the housing surrounding the pump and pump drive which is below the pump, forming an annular space.

25. A fuel fractionation assembly according to claim 24, wherein the pump is provided on a circumferential side with cooling fins which project into the space, and wherein a heat exchanger is arranged in the space, between the housing and the pump drive.

26. A method of making a fuel fractionation device for separating a low-boiling fuel fraction from a liquid fuel for use in an internal combustion engine, comprising:

providing a fuel tank which operatively contains the liquid fuel, fixing a pump and a pump drive in a housing, the pump operatively extracting fuel vapor and air, forming a structural unit by combining a separator and a reservoir with the housing, and removably accommodating the structural unit in the fuel tank, wherein the separator and the reservoir are arranged so that an extracted fuel fraction mixture is operatively feedable to the separator and the reservoir.

* * * * *